US005402209A

United States Patent [19]

Itoyama et al.

[11] Patent Number: 5,402,209

[45] Date of Patent: Mar. 28, 1995

[54] ELECTROPHOTOGRAPHIC REPRODUCTION APPARATUS CONTROLLABLE TONER DENSITY AND METHOD THEREOF FOR CONTROLLING AN ELECTROPHOTOGRAPHIC REPRODUCTION PROCESS

[75] Inventors: Motoyuki Itoyama, Yamatokoriyama; Mitsuru Tokuyama, Nara; Toshiaki Ino, Yamatokoriyama; Kunio Ohashi, Nara, all of Japan

[73] Assignee: Sharp Kabushiki Kaisha, Osaka, Japan

[21] Appl. No.: 102,344

[22] Filed: Aug. 5, 1993

[30] Foreign Application Priority Data

Aug. 27, 1992 [JP] Japan ..... 4-228189

[51] Int. Cl.[6] ..... G03G 21/00

[52] U.S. Cl. ..... 355/208; 118/691; 355/246

[58] Field of Search ..... 355/245, 233, 246, 228, 355/208, 203; 118/688-691, 665

[56] References Cited

U.S. PATENT DOCUMENTS

| | | | |
|---|---|---|---|
| 4,313,671 | 2/1982 | Kuru | 118/688 X |
| 4,348,099 | 9/1982 | Fantozzi | 355/208 |
| 4,519,695 | 5/1985 | Murai et al. | 118/691 X |
| 4,693,593 | 9/1987 | Gerger | 355/208 |
| 4,829,336 | 5/1989 | Champion et al. | 355/246 |
| 4,878,082 | 10/1989 | Matsushita et al. | 355/208 |
| 4,962,407 | 10/1990 | Ueda | 355/246 X |
| 5,107,302 | 4/1992 | Bisaji | 355/246 |
| 5,294,959 | 3/1994 | Nagao et al. | 355/208 |

FOREIGN PATENT DOCUMENTS

| | | |
|---|---|---|
| 54-34239 | 3/1979 | Japan . |
| 55-127573 | 10/1980 | Japan . |
| 55-161266 | 12/1980 | Japan . |
| 4-347870 | 12/1992 | Japan . |

*Primary Examiner*—A. T. Grimley
*Assistant Examiner*—Shuk Y. Lee
*Attorney, Agent, or Firm*—David G. Conlin; Peter F. Corless

[57] ABSTRACT

An apparatus includes a system controller which calculates a ratio of a first signal to a second signal and adjusts a control parameter of an electrophotographic reproduction process so that the density of fog indicated by the ratio is within a predetermined range. A first optical sensor outputs the first signal by detecting a reflectance of a non-image area on the photoreceptor between a developing unit and a transfer charger. A second optical sensor outputs the second signal by detecting a reflectance of a surface of the photoreceptor between a cleaning unit and a charger. The system controller controls developer including toner and carrier to be agitated when the ratio obtained after adjusting the control parameter is still outside the predetermined range. Since the density of fog is detected with accuracy by calculating the ratio, copy quality is stabilized even when temperature changes. Moreover, even if the ratio is outside the predetermined range as a result of the supply of toner which has deteriorated due to a heat history, the deterioration of toner is restored by agitating the developer. It is thus possible to prevent copy quality from being degraded.

26 Claims, 5 Drawing Sheets

ELECTROPHOTOGRAPHIC REPRODUCTION APPARATUS CONTROLLABLE TONER DENSITY AND METHOD THEREOF FOR CONTROLLING AN ELECTROPHOTOGRAPHIC REPRODUCTION PROCESS

FIELD OF THE INVENTION

The present invention relates to electrophotographic reproduction apparatuses such as copying machines and laser printers and to a method for controlling an electrophotographic reproduction process.

BACKGROUND OF THE INVENTION

In an electrophotographic reproduction apparatus, in order to maintain good copy quality over a long period of time, the electrophotographic reproduction process is controlled according to environmental changes. More specifically, an optical sensor detects a reflectance of a bare surface of a photoreceptor and outputs a reference signal representing the reflectance. A specific control parameter of the electrophotographic reproduction process is changed in accordance with the reference signal. The control parameter is, for example, a lamp voltage, a voltage of a charger, a development bias voltage or a voltage of a discharger.

Copy quality deteriorates when the density of fog increases. The fog density is a lightness of a non-image area of a copy. An increase in the fog density is caused by various factors. The major factors are an increase in the residual potential of the photoreceptor and the deterioration of developer due to environmental changes or aged toner. A two-component series dry developer having toner and carrier is used in such an apparatus.

With a conventional process control, it is impossible to compensate for an increase in the fog density caused by the deterioration of toner due to heat history.

There may be a case where an electrophotographic reproduction apparatus is stored in a warehouse or transported under hot heat and where toner inside the apparatus is kept under a temperature of around 50° for about two days. If the toner has such a heat history, the resin of the toner is softened and the charging characteristic of the toner deteriorates due to thermal stress. If the deteriorated toner is supplied, the fog density may increase even when the control parameter is properly set. Such an increase in the fog density can not be compensated by adjusting the lamp voltage and the development bias voltage.

A copy with an increased fog density would not appear to be right and the user judges that the copy has extremely low quality.

In addition, when the fog density is increased by the deteriorated toner, an erroneous reference signal may be delivered. If the control parameter is adjusted in accordance with such an erroneous reference signal, the copy quality would be degraded and an excessively great amount of toner is consumed for development. The excess toner results in uneconomical operation including flying of toner.

In recent years, an additive is used so that, even if toner has a heat history and deteriorates, it does not affect copy quality. However, the problem of high fog density has not yet been fully solved.

SUMMARY OF THE INVENTION

It is an object of the present invention to provide an electrophotographic reproduction apparatus capable of preventing an increase in the density of fog and uneconomical problems including flying of toner by quantitatively estimating the increase in the fog density even when toner which has deteriorated by a heat history is supplied.

In order to achieve the above object, an electrophotographic reproduction apparatus of the present invention includes:

an electrophotographic processing section, the electrophotographic processing section including a light source, a photoreceptor on which an electrostatic latent image is formed by light from the light source, developing means for developing the electrostatic latent image into a visible image so as to form an image area and a non-image area on the photoreceptor, transfer means for transferring the visible image to a copy material, and cleaning means for cleaning the surface of the photoreceptor after transfer;

first detecting means for optically detecting a reflectance of the non-image area and outputting a first detection signal;

second detecting means for optically detecting a reflectance of the photoreceptor after being cleaned by the cleaning means and outputting a second detection signal; and control means for calculating a ratio of the first detection signal to the second detection signal and controlling a control parameter of the electrophotographic processing section so that the ratio is within a predetermined range.

It is also possible to provide the developing means with agitating means for agitating developer including toner and carrier, and to control the agitating means by the control means so that the agitating means agitates the developer when the ratio obtained after adjusting the control parameter is still outside the predetermined range.

It is also possible to provide toner supply means for supplying the toner to the developing means, and to control the toner supply means by the control means so that a toner density in the developer is lowered when the ratio obtained after agitating the developer is still outside the predetermined range.

The ratio shows a fog density which indicates the lightness of a surface of the photoreceptor between the developing means and the transfer means, and becomes smaller as the fog density increases.

Fog example, the control parameter is a developing bias voltage or the voltage of the light source. The toner density is a ratio of the toner in the developer including the toner and carrier.

With this structure, the ratio of the first detection signal to the second detection signal is calculated by the control means. In accordance with the ratio, the control parameter of the electrophotographic processing section is controlled.

Since it is possible to make the temperature dependency of the first detecting means and that of the second detecting means substantially equal, even when a change in temperature occurs, the temperature dependency of the first detecting means is cancelled by the temperature dependency of the second detecting means by calculating the ratio.

Namely, the fog density is detected with accuracy irrespective of changes in temperature. Since the electrophotographic reproduction process is controlled by the ratio indicating the fog density, it is possible to prevent the image quality on the copy material from being degraded over a long period of time.

When the ratio is outside a predetermined range and when the fog density increases, if the fog density is not reduced even after adjusting the control parameter, the toner in the developer is considered as deteriorated. The characteristic of the toner is restored by agitating the developer with the agitating means and charging the toner, which has deteriorated as a result of the heat history, by friction between the toner and the carrier. It is therefore possible to restrain an increase in the fog density and to prevent the image quality on the copy material from being degraded.

In addition to the agitation of the developer, when the toner density in the developer is lowered by the toner supply means, the efficiency of charging the toner by friction between the carrier and the toner produced by agitating the developer is improved. This arrangement restrains an increase in the fog density and prevents the image quality on the copy material from being degraded.

For a fuller understanding of the nature and advantages of the invention, reference should be made to the ensuing detailed description taken in conjunction with the accompanying drawings.

DESCRIPTION OF THE EMBODIMENT

The following description discusses one embodiment of the present invention with reference to FIGS. 1 through 8.

Figure 1:
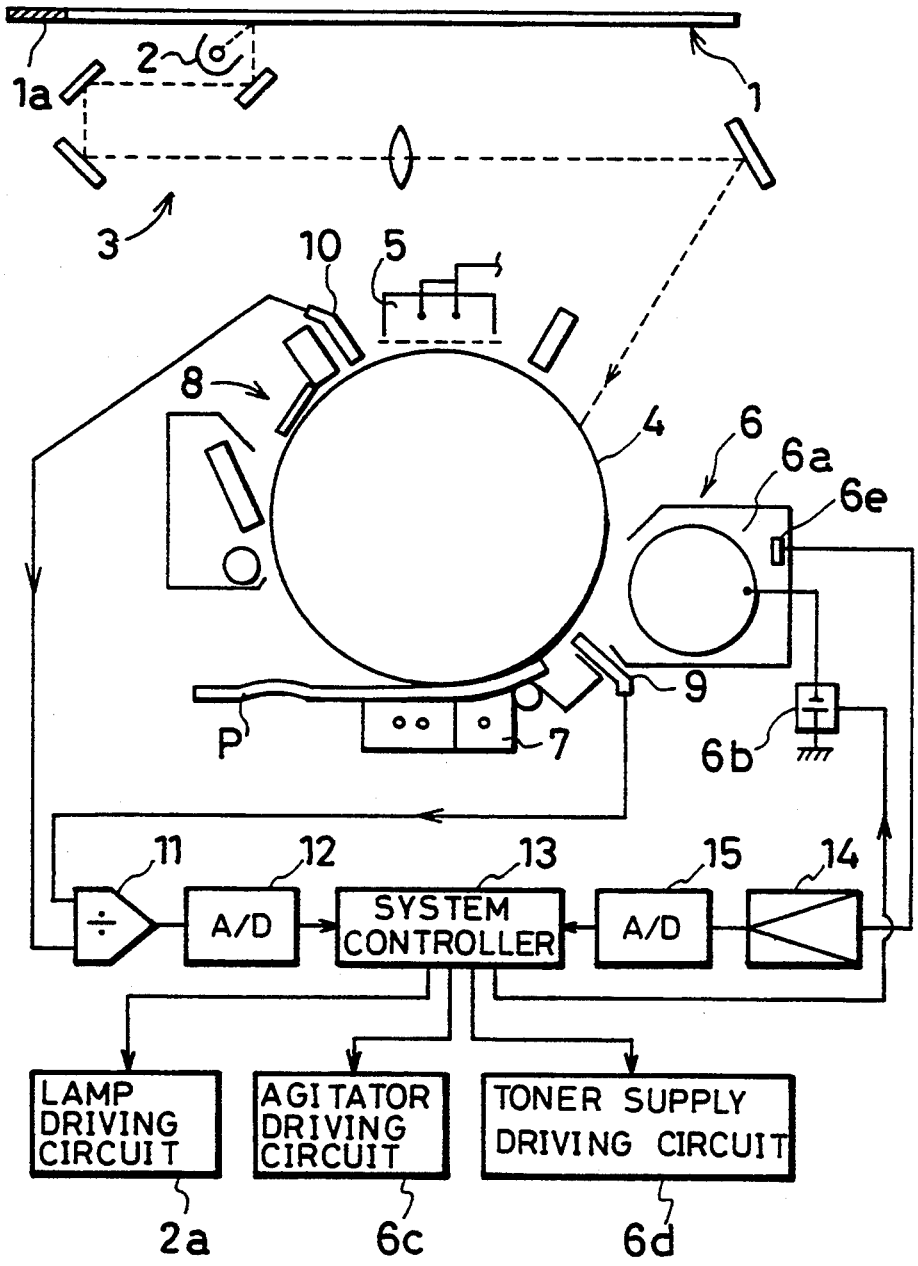
FIG. 1 is a view illustrating the structure of an electrophotographic reproduction apparatus of the present invention.

A copying machine as an electrophotographic reproduction apparatus has an electrophotographic processing section for forming an image on a copy material. As illustrated in FIG. 1, the electrophotographic processing section includes a drum-shaped photoreceptor 4, a document platen 1 located above the photoreceptor 4, a copying lamp 2 and an optical system 3. Further, in the electrophotographic processing section, a charger 5, a developing unit 6, a transfer charger 7 and a cleaning unit 8 are disposed in this order in a clockwise direction around the photoreceptor 4. The electrophotographic processing section also includes means for supplying copy material between the photoreceptor 4 and the transfer charger 7, a fusing unit for fusing an image on the copy material, and a toner supply unit for supplying toner to the developing unit 6 as to be described later although those members are not shown in the drawings.

In the copying machine, light from the copying lamp 2 is projected onto a document placed on the document platen 1, and reflected light from the document is directed to a surface of the photoreceptor 4 by the optical system 3. The source voltage of the copying lamp 2 is controlled by a lamp driving circuit 2*a*.

A standard white plate 1*a* is mounted on one end of the document platen 1. When a portion of the photoreceptor 4 where the image of the standard white plate 1*a* is formed is developed, the reflectance of the portion is detected by a first optical sensor 9, to be described later. The reflectance corresponds to the fog density of the photoreceptor 4. The fog density shows the lightness of a non-image area on a copy.

The photoreceptor 4 is produced by shaping an aluminum drum having a wall thickness of 2 mm, a diameter of 100 mm and a length of 340 mm, and by evenly applying an organic semiconductor to the outer surface of the aluminum drum so as to form a photoconductive layer with a thickness of 1 $\mu$m. The photoreceptor 4 is rotated in a clockwise direction. The photoconductive layer is charged by the charger 5, and then light is projected onto the photoreceptor 4 by the optical system 3 to form an electrostatic latent image on the photoconductive layer.

The developing unit 6 stores developer having toner and carrier, and develops the discharged latent image into visible form with the toner. The developing unit 6 includes a developer container 6*a* having an agitator with rotating blades, not shown, a bias voltage source 6*b*, an agitator driving circuit 6*c*, a toner supply driving circuit 6*d* and a toner control sensor 6*e*. The bias voltage source 6*b* applies a bias voltage to the toner. The developer in the developer container 6*a* is agitated by a drive signal from the agitator driving circuit 6*c*. The developer container 6*a* includes the above-mentioned toner supply unit, not shown, for supplying the toner from a separately provided toner supply, not shown, to the developer container 6*a* by a drive signal from the toner supply driving circuit 6*d*. The toner control sensor 6*e* detects a toner density (i.e., the ratio of toner in the developer) in the developer container 6*a*.

The transfer charger 7 transfers the toner image on the photoreceptor 4 to copy paper P. The copy paper P is transported from the transfer charger 7 to the fusing unit, not shown, where the toner image is fused on the copy paper P, and discharged from the copying machine.

The cleaning unit 8 located between the transfer charger 7 and the charger 5 cleans the surface of the photoreceptor 4 before the next copying process starts.

The first optical sensor 9 is disposed between the developing unit 6 and the transfer charger 7 to detect the non-image area corresponding to the standard white plate 1*a*. A second optical sensor 10 is disposed between the cleaning unit 8 and the charger 5.

Each of the optical sensors 9 and 10 includes a light emitting diode and a phototransistor. The light emitting diode applies light to the surface of the photoreceptor 4, and the phototransistor receives reflected light from the surface. Thus, the optical sensors 9 and 10 output signals as a function of the reflectance of the illuminated portion of the photoreceptor 4.

Namely, the first optical sensor 9 detects a reflectance of the non-image area on the photoreceptor 4 where the image of the standard white plate 1*a* has been developed, and outputs the result as bare surface data (i.e., as a numerical signal corresponding to the fog density). On the other hand, the second optical sensor 10 detects a reflectance of the photoreceptor 4 after cleaned by the cleaning unit 8, and outputs the result as a numerical signal.

The outputs of the optical sensors 9 and 10 are respectively input to a divider 11 where the output of the first optical sensor is divided by the output of the second optical sensor 10 to obtain an output ratio A. The output ratio A is converted into digital form by an A/D convertor 12, and input to a system controller 13 such as a microcomputer.

Meanwhile, an output of the toner control sensor 6*e* is amplified by an amplifier 14, converted into digital form by an A/D convertor 15, and then input to the system controller 13.

The system controller 13 takes data from the A/D convertors 12 and 15 at very small intervals in accordance with a program described later. The system controller 13 then outputs control signals to the lamp driving circuit 2*a*, the bias voltage source 6*b*, the agitator driving circuit 6*c* and the toner supply driving circuit 6*d* in accordance with the data. Additionally, the system controller 13 includes means, not shown, for halting the respective members in the electrophotographic processing section.

The above-mentioned output ratio A is quantitative information which allows accurate estimation of the fog density. The numerical value of the output of the first optical sensor 9 representing the fog density on the photoreceptor 4 contains errors due to the temperature dependency of the first optical sensor 9.

Figure 2:
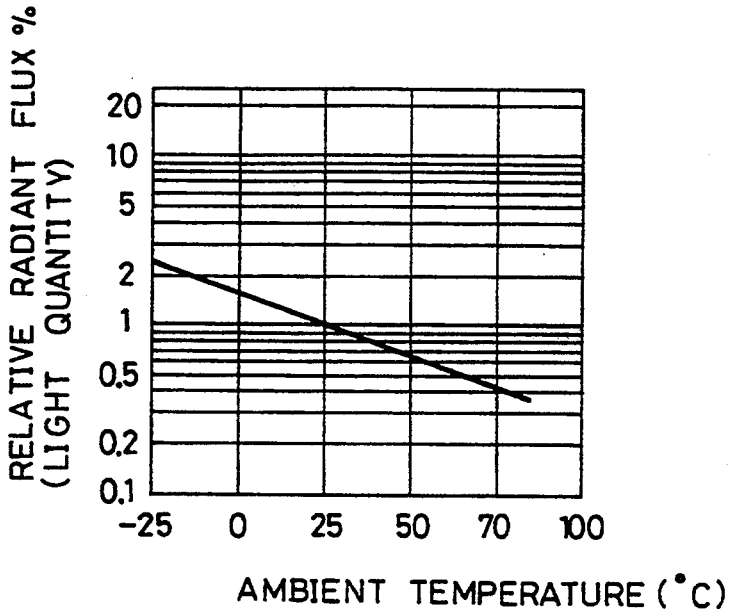
FIG. 2 is a graph illustrating the relationship between the light quantity of an optical sensor and temperature in the electrophotographic reproduction apparatus.

FIG. 2 is a graph showing the relationship between temperatures and changes in the light quantity of a light emitting diode to be used as a light emitting element in an optical sensor of this type. As is clear from the graph, the light quantity decreases as ambient temperature rises and, even when the photoreceptor 4 exhibits a uniform reflectance, the output of the optical sensor 9 varies as the temperature changes.

By calculating the output ratio A, the temperature dependency of the output of the first optical sensor 9 is cancelled by the output of the second optical sensor 10. Namely, the output ratio A is data which accurately indicates a residual toner amount in the non-image area on the photoreceptor 4 after development independently of changes in ambient temperature.

Figure 3:
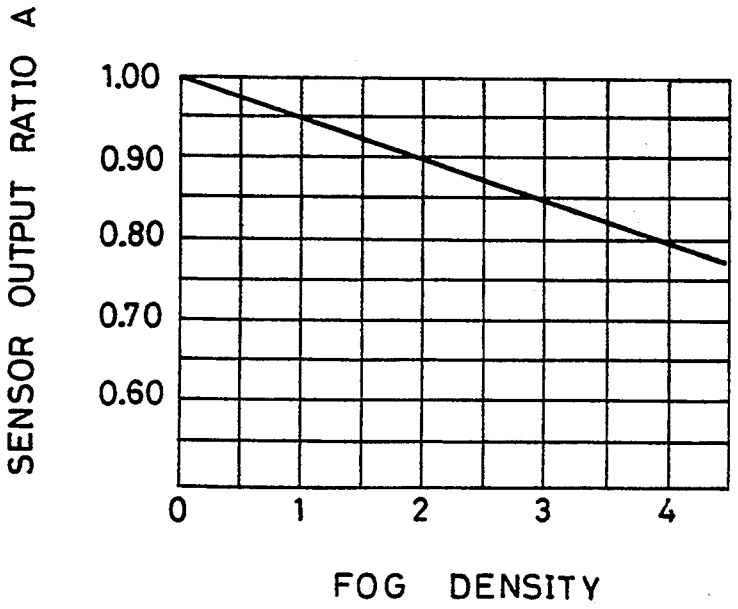
FIG. 3 is a graph illustrating the relationship between an output ratio A of the electrophotographic reproduction apparatus and the density of fog on a copy.
Figure 4:
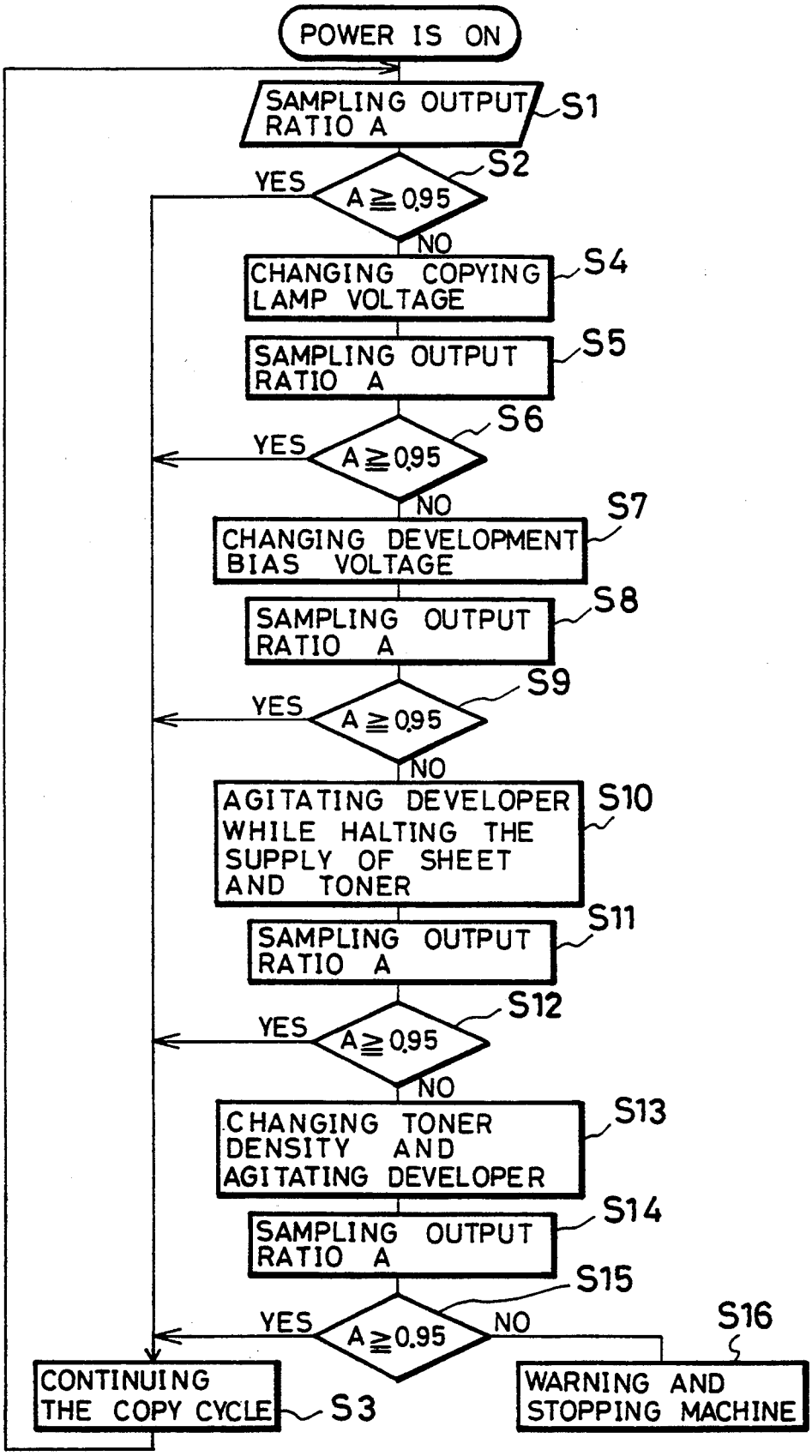
FIG. 4 is a flow chart of an operation of the electrophotographic reproduction apparatus.
Figure 5:
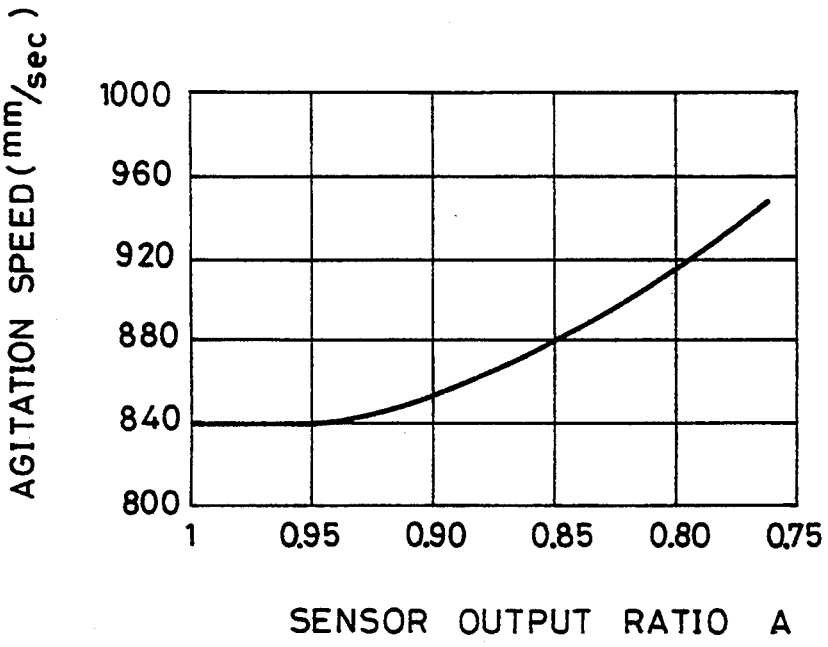
FIG. 5 is a graph showing the relationship between an optimum speed of agitating developer and an output ratio A in the electrophotographic reproduction apparatus.
Figure 6:
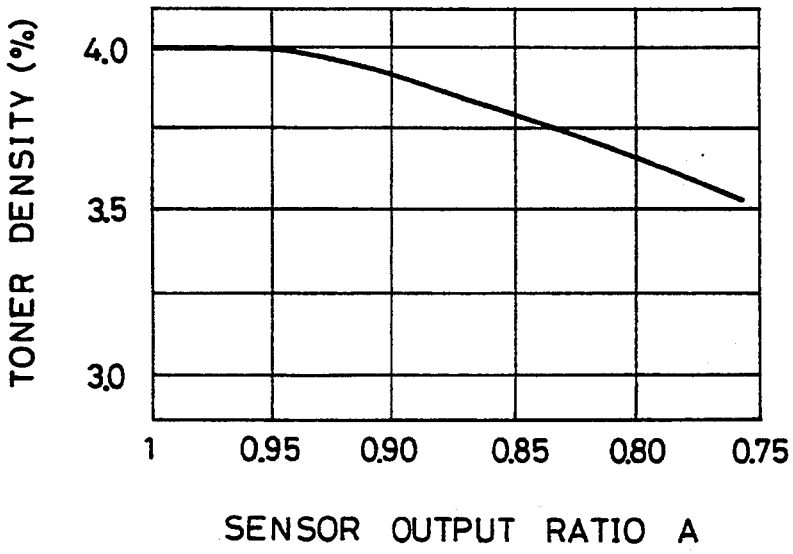
FIG. 6 is a graph showing the relationship between an optimum toner density and an output ratio A in the electrophotographic reproduction apparatus.

As shown in FIG. 3, the output ratio A closely correlates with the fog density. In this example, when the output ratio A is between 1 and 0.95, an amount of residual toner on the non-image area is within a permitted limit.

The following description discusses an operation of the machine with reference to the flow chart of the program written in the system controller 13 shown in FIG. 1.

Firstly, the output ratio A is sampled by the system controller 13 (step 1). Then, whether the output ratio A is between 1 and 0.95 is detected (step 2). When the output ratio A is between 1 and 0.95, the electrophotographic reproduction process is judged optimum and the current copy cycle continues to be used (step 3). On the other hand, when the output ratio A is smaller than 0.95, the source voltage of the copying lamp 2 is adjusted (step 4).

After the adjustment of the source voltage, a new output ratio A is sampled by the system controller 13 (step 5). Thereafter whether the output ratio A is between 1 and 0.95 is detected (step 6). When the output ratio A is between 1 and 0.95, the electrophotographic reproduction process is judged optimum and the current copy cycle continues to be used (step 3). On the other hand, when the output ratio A is smaller than 0.95, the bias voltage of the developing unit 6 is adjusted (step 7).

In the case when toner which has deteriorated due to a heat history is supplied to the developer container 6*a*, the fog density can not often be reduced by the adjustment of those two control parameters. If those control parameters continue to be adjusted, copy quality deteriorates and the consumption of toner increases as mentioned before.

After adjusting the bias voltage, a new output ratio A is sampled by the system controller 13 (step 8). Then, whether the new output ratio A is between 1 and 0.95 is detected (step 9). When the output ratio A is between 1 and 0.95, the electrophotographic reproduction process is judged optimum and the current copy cycle continues to be used (step 3). On the other hand, when the output ratio A is smaller than 0.95, the supply of paper to the photoreceptor 4 and the supply of toner to the developer container 6*a* are suspended, while the developer in the developer container 6*a* is agitated for a predetermined time at an optimum speed corresponding to the output ratio A (step 10, see FIG. 5). The agitation speed is indicated by the tip speed of the blades of the agitator. The toner which has deteriorated due to the friction with the carrier is charged by agitating the developer. The agitation enables the toner to regain its original ability.

Then, the output ratio A is sampled by the system controller 13 (step 11) and whether the newly sampled value is between 1 and 0.95 is examined (step 12). If the output ratio A is between 1 and 0.95, the electrophotographic reproduction process is judged optimum and the current copy cycle continues to be used (step 3).

If the output ratio A does not reach 0.95 even after agitation, the toner in the developer container 6*a* is agitated while restricting the supply of toner so as to lower the toner density in the developer container 6*a* (step 13).

Namely, with regular control, the toner density in the developer container 6*a* is separately controlled in accordance with the output of the toner control sensor 6*e* so as to be always 4%, for example. However, if the output ratio A does not improve even after agitation, the toner density is reduced according to a lowering of the output ratio A (see FIG. 6) and the developer is agitated. If agitation is performed when the toner density in the developer container 6*a* is lowered, i.e., when the ratio of toner to carrier is low, the charging efficiency of toner is improved. Thus, the possibility that the toner regains its original ability becomes higher.

After making the above-mentioned adjustments, the copying process is resumed. A new output ratio A is sampled by the system controller 13 (step 14), and whether the value is between 1 and 0.95 is examined (step 15). If the output ratio A is between 1 and 0.95, the electrophotographic reproduction process is judged optimum and the copy cycle continues to be used (step 3).

If the output ratio A after those adjustments does not reach 0.95, a warning is given or the copying operation is suspended and it is notified to the user (step 16).

By giving such a notification, even if toner which has deteriorated due to a heat history is supplied, an increase in the fog density is prevented without degrading other elements of the copy quality.

Figure 7:
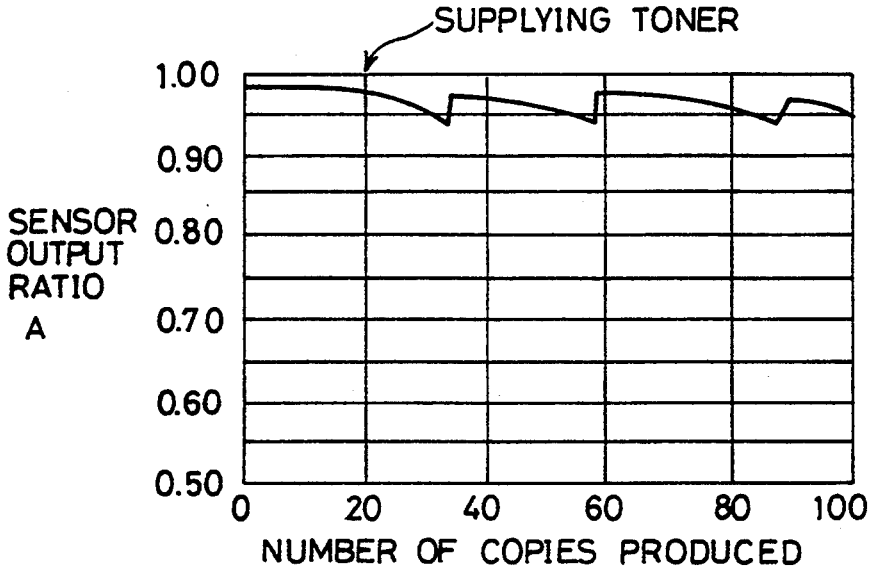
FIG. 7 is a graph showing the relationship between an output ratio A and the number of copies produced in the electrophotographic reproduction apparatus, wherein the copies were continually produced while supplying deteriorated toner, and wherein agitating the toner and restricting the toner density were controlled in accordance with the output ratio A.

FIG. 7 is a graph illustrating how the output ratio A changes with the elapse of time if deteriorated toner is supplied by showing the number of copies produced in the horizontal axis. Every time the output ratio A falls below 0.95, the toner in the developer container 6a is agitated. In other words, as the toner is charged by agitating it within the limit of the toner density, it is possible to prevent the output ratio A from dropping far below 0.95. Thus, the fog density is controlled not to exceed a permitted limit.

Figure 8:
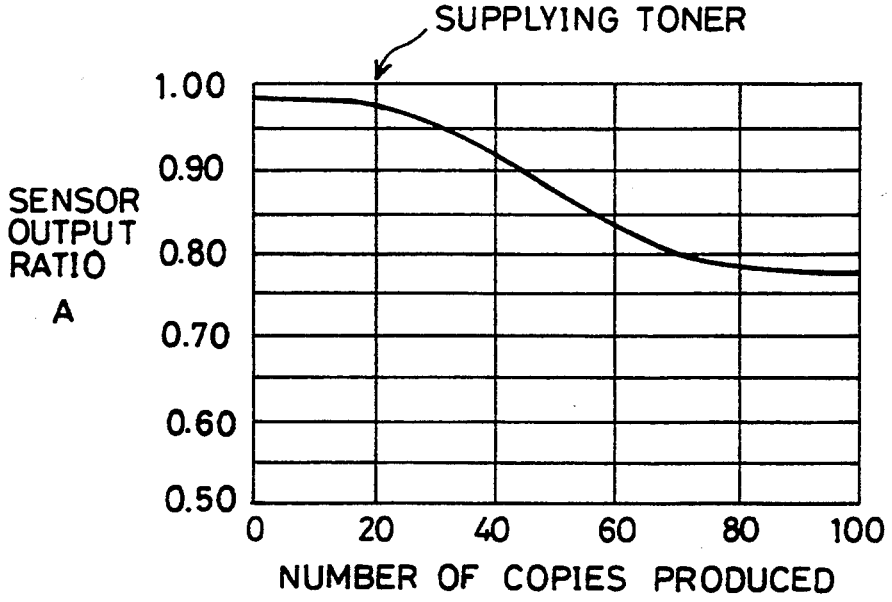
FIG. 8 is a graph of a comparative example showing the relationship between an output ratio A and the number of copies produced, wherein the toner was not agitated and the toner density was not restricted.

Meanwhile, when the deteriorated toner was supplied without agitating the developer in the developer container 6a and restricting the toner density, the output ratio A changed as shown in the graph of FIG. 8. As is clear from the graph, even when other control parameters are adjusted, the value of the output ratio A is not much improved, causing the fog density to gradually increase.

As described above, with the structure of this embodiment, since the second optical sensor 10 is provided in addition to the first optical sensor 9 so that the temperature dependency of the first optical sensor 9 and that of the second optical sensor 10 are balanced out. This structure allows the output ratio A which is not affected by changes in temperature to be obtained. By adjusting the respective control parameters in accordance with the output ratio A indicating the fog density, stable copy quality is obtained over a long period of time irrespective of changes in ambient temperature.

When the fog density is increased by an output ratio A outside a predetermined range, control parameters are adjusted by the system controller 13. If the fog density is not reduced even after adjustment, the increase in the fog density is presumed to be caused by the deteriorated toner.

The toner in the developer container 6a whose abilities to flow and to be charged have deteriorated is agitated by the agitator and charged by friction with carrier so as to recover the toner characteristic. By reducing the fog density in this manner, degradation of copy quality is prevented.

Moreover, by reducing the toner density in the developer, i.e., the ratio of the toner to the carrier, in addition to the agitation of the developer, the efficiency of charging the toner by friction between the toner and the carrier is improved. This also enables the fog density to be reduced and prevents the copy quality from being degraded.

With this structure, it is not necessary to perform both the agitation of developer in the developer container 6a and the agitation thereof while limiting the toner density. In the case when the output ratio A is not improved after the agitation of the developer, it is possible to give a warning without limiting the toner density. In the case when the output ratio A is not improved after adjusting the development bias voltage, it is possible to immediately restrict the toner density and agitate the developer in the developer container 6a.

In the above-mentioned embodiment, the electrophotographic reproduction process is adapted to a copying machine. However, it is also possible to adapt the process to a system such as a laser printer in which an electrostatic latent image formed on the photoreceptor 4 is developed into visible form with developer.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An electrophotographic reproduction apparatus comprising:

an electrophotographic processing section including a light source, a photoreceptor for forming an electrostatic latent image with light from said light source, developing means for developing the electrostatic latent image into a visible image so as to form an image area and a non-image area on said photoreceptor, transfer means for transferring the visible image to a copy material, and cleaning means for cleaning a surface of said photoreceptor after transferring the visible image;

first detecting means for optically detecting a reflectance of the non-image area on said photoreceptor and for transmitting a first detection signal;

second detecting means for optically detecting a reflectance of said photoreceptor after being cleaned by said cleaning means and for transmitting a second detection signal; and control means for calculating a ratio of the first detection signal to the second detection signal and for controlling a control parameter of said electrophotographic processing section so that the ratio is within a predetermined range.

2. The electrophotographic reproduction apparatus according to claim 1, further comprising a document platen on which a document is placed, said document platen having a white plate installed at a portion thereof, the document being illuminated by light from said light source, wherein said white plate is illuminated by light from said light source and reflected light from said white plate is directed to said photoreceptor, the non-image area corresponds to a portion on said photoreceptor where an electrostatic latent image of said white plate is developed, and said first detecting means is disposed between said developing means and said transfer means so as to detect a reflectance of the non-image area.

3. The electrophotographic reproduction apparatus according to claim 2, wherein said electrophotographic processing section further comprising charging means for charging the surface of said photoreceptor, and wherein said second detecting means is disposed between said cleaning means and said charging means so as to detect a reflectance of the surface of said photoreceptor.

4. The electrophotographic reproduction apparatus according to claim 1, wherein each of said first and second detecting means is an optical sensor including a light emitting diode and a phototransistor.

5. The electrophotographic reproduction apparatus according to claim 1, wherein the control parameter is a voltage of said light source.

6. The electrophotographic reproduction apparatus according to claim 1, wherein the control parameter is a development bias voltage of said developing means.

7. The electrophotographic reproduction apparatus according to claim 1, wherein said developing means contains developer for developing the electrostatic latent image, the developer having toner and carrier.

8. The electrophotographic reproduction apparatus according to claim 7, further comprising agitating means for agitating the developer, wherein said control means controls said agitating means to agitate the developer when the ratio obtained after adjusting the control parameter by said control means is still outside the predetermined range.

9. The electrophotographic reproduction apparatus according to claim 8, wherein an agitation speed of said agitating means is inversely proportional to the ratio, the agitation speed becoming higher as the ratio becomes smaller.

10. The electrophotographic reproduction apparatus according to claim 8, wherein said control means includes means for halting said electrophotographic processing section when the developer is agitated by said agitating means.

11. The electrophotographic reproduction apparatus according to claim 10, wherein said electrophotographic processing section further comprising means for supplying a copy material to said photoreceptor.

12. The electrophotographic reproduction apparatus according to claim 10, wherein said electrophotographic processing section further comprising toner supplying means for supplying toner to said developing means.

13. The electrophotographic reproduction apparatus according to claim 12, wherein said control means controls said toner supplying means to lower a density of the toner in said developing means by restricting a supply of the toner when the ratio obtained after agitating the developer by said agitating means is still outside the predetermined range.

14. The electrophotographic reproduction apparatus according to claim 13, wherein the toner density is lowered as the ratio becomes smaller.

15. A method for controlling an electrophotographic reproduction process in an electrophotographic reproduction apparatus comprising, a light source, a photoreceptor, developing means, transfer means, and cleaning means, said control method comprising the steps of:

(a) forming an electrostatic latent image on said photoreceptor with light from said light source;

(b) developing the electrostatic latent image into a visible image by said developing means so as to form an image area and a non-image area on said photoreceptor;

(c) optically detecting a reflectance of the non-image area and outputting a first detection signal;

(d) transferring the visible image to a copy material by said transfer means;

(e) cleaning a surface of said photoreceptor by said cleaning means after transferring the visible image;

(f) optically detecting a reflectance of said photoreceptor after being cleaned and outputting a second detection signal; and (g) calculating a ratio of the first detection signal to the second detection signal and controlling a control parameter of said electrophotographic reproduction process so that the ratio is within a predetermined range.

16. The method for controlling an electrophotographic reproduction process of an electrophotographic reproduction apparatus according to claim 15, wherein the non-image area is a portion on said photoreceptor where an electrostatic latent image of a white plate is developed, said white plate being mounted on a portion of a document platen being illuminated by light from said light source, and wherein detecting a reflectance of the non-image area in step (c) is performed at a point between said developing means and said transfer means.

17. The method for controlling an electrophotographic reproduction process of an electrophotographic reproduction apparatus according to claim 15, further comprising the step of charging a surface of said photoreceptor by charging means prior to step (a), wherein detecting a reflectance of the surface of said photoreceptor in step (f) is performed at a point between said cleaning means and said charging means.

18. The method for controlling an electrophotographic reproduction process of an electrophotographic reproduction apparatus according to claim 15, wherein each of steps (c) and (f) includes projecting light onto the surface of said photoreceptor by a light emitting diode, and receiving reflected light from the surface by a phototransistor.

19. The method for controlling an electrophotographic reproduction process of an electrophotographic reproduction apparatus according to claim 15, wherein the control parameter is a voltage of said light source.

20. The method for controlling an electrophotographic reproduction process of an electrophotographic reproduction apparatus according to claim 15, wherein the control parameter is a development bias voltage of said developing means.

21. The method for controlling an electrophotographic reproduction process of an electrophotographic reproduction apparatus according to claim 15, further comprising the step of (h) agitating developer having toner and carrier in said developing means when the ratio obtained after adjusting the control parameter is still outside the predetermined range.

22. The method for controlling an electrophotographic reproduction process of an electrophotographic reproduction apparatus according to claim 21, wherein an agitation speed in step (h) is inversely proportional to the ratio, the agitation speed becoming higher as the ratio becomes smaller.

23. The method for controlling an electrophotographic reproduction process of an electrophotographic reproduction apparatus according to claim 21, further comprising the step of halting the electrophotographic reproduction process when agitating the developer in step (h) is performed.

24. The method for controlling an electrophotographic reproduction process of an electrophotographic reproduction apparatus according to claim 15, further comprising the step of lowering a density of toner in developer stored in said developing means when the ratio obtained after adjusting the control parameter is still outside the predetermined range, the developer having the toner and carrier.

25. The method for controlling an electrophotographic reproduction process of an electrophotographic reproduction apparatus according to claim 21, further comprising the step of lowering a density of toner in the developer stored in said developing means when the ratio obtained after agitating the developer by said agitating means is still outside the predetermined range.

26. The method for controlling an electrophotographic reproduction process of an electrophotographic reproduction apparatus according to claim 25, wherein the toner density is inversely proportional to the ratio, the toner density becoming greater as the ratio becomes smaller.

* * * * *